US010094088B1

(12) United States Patent
Sydlik

(10) Patent No.: US 10,094,088 B1
(45) Date of Patent: Oct. 9, 2018

(54) SHEET PILE RETAINING WALL SYSTEM

(71) Applicant: Michael Sydlik, Pittsburgh, PA (US)

(72) Inventor: Michael Sydlik, Pittsburgh, PA (US)

(73) Assignee: Earth, Inc., Pittsburgh, PA (US)

( * ) Notice: Subject to any disclaimer, the term of this patent is extended or adjusted under 35 U.S.C. 154(b) by 0 days.

(21) Appl. No.: 15/799,162

(22) Filed: Oct. 31, 2017

(51) Int. Cl.

| | |
|---|---|
| ***E02D 5/02*** | (2006.01) |
| ***E02D 17/18*** | (2006.01) |
| ***E02D 5/08*** | (2006.01) |
| ***E02D 17/20*** | (2006.01) |
| ***E02D 29/02*** | (2006.01) |
| ***E02D 5/04*** | (2006.01) |
| ***E02D 7/02*** | (2006.01) |

(52) U.S. Cl.
CPC ..... *E02D 17/207* (2013.01); *E02D 5/04* (2013.01); *E02D 7/02* (2013.01); *E02D 29/02* (2013.01); *E02D 29/0233* (2013.01); *E02D 2200/12* (2013.01); *E02D 2300/0018* (2013.01); *E02D 2300/0032* (2013.01); *E02D 2600/20* (2013.01); *E02D 2600/30* (2013.01)

(58) Field of Classification Search
CPC .... E02D 5/02; E02D 5/04; E02D 5/08; E02D 17/207; E02D 7/02–7/165; E02D 29/02; E02D 29/0233
USPC ..... 405/274, 276–281
See application file for complete search history.

(56) References Cited

U.S. PATENT DOCUMENTS 1,277,847 A * 9/1918 Cahn ..... E02D 19/04 405/14
2,001,473 A * 5/1935 Smith ..... E02B 3/068 405/14
3,492,826 A * 2/1970 Gardner ..... E02D 29/0266 405/281
5,145,287 A * 9/1992 Hooper ..... E02B 3/066 405/262
6,715,964 B2 4/2004 Nottingham
2008/0145153 A1* 6/2008 Wendt ..... E02B 3/108 405/274
2008/0152435 A1 6/2008 Heindl
(Continued)

FOREIGN PATENT DOCUMENTS

DE 4226067 A1 * 5/1993 ..... E01F 8/0023
JP 60059228 A * 4/1985

*Primary Examiner* — Benjamin F Fiorello
*Assistant Examiner* — Stacy N Lawson
(74) *Attorney, Agent, or Firm* — Dunlap Bennett & Ludwig, PLLC

(57) ABSTRACT

A one-step sheet pile retaining wall system for embankment widening typically associated with highway widening not requiring temporary shoring. The wall system may provide a front wall face having a plurality of resistance fins perpendicularly extending therefrom. The fin sheet piles first include a brace fin sheet for reducing stresses in the front wall face, then a series of cradle fin sheets terminating at an elevation below the brace fin sheet for accommodating a pipe drainage/utility cradle, and finally a series of predominantly resistance fin sheets terminating at an elevation above the cradle fin sheets. Between the slope of the existing embankment and the higher front wall face may be cementitious flowable backfill for pre-stressing the wall system when fluid and, when set, supporting the aforementioned cradle, from which the remaining construction can build off of while reducing overall earth pressure acting on the wall face upon completion of construction.

9 Claims, 4 Drawing Sheets

(56) References Cited

U.S. PATENT DOCUMENTS

| | | | | |
|---|---|---|---|---|
| 2011/0064527 | A1 | 3/2011 | Nottingham et al. | |
| 2011/0188948 | A1* | 8/2011 | Heindl | E02D 5/08 405/274 |
| 2012/0076594 | A1* | 3/2012 | Park | E02D 5/02 405/285 |

* cited by examiner

SHEET PILE RETAINING WALL SYSTEM

BACKGROUND OF THE INVENTION

The present invention relates to earth retaining systems and, more particularly, to a one-step sheet pile retaining wall system not requiring temporary shoring.

Current earth retaining systems designed to accommodate significant embankment widening, particularly along existing roadway where traffic will be running adjacent to the work, require massive quantities of excavation and the utilization of select rock/aggregate backfill as well as the need for costly and time-consuming temporary shoring.

Specifically, current earth retaining systems associated with embankment widening involve a two-stage process: (1) temporary shoring installation and (2) then wall construction. Such systems typically include a MSE wall, T-Wall, reinforced concrete cantilever wall, or soldier beam and lagging wall (with regard to providing a platform of sufficient width from which to drill/construct the soldier beam and lagging wall).

Temporary shoring can be problematic when retaining an embankment for doing construction along the top of the embankment, such as for widening of a highway. For instance, since the temporary typically-vertical shoring would often extend well below the level of the highway, such effort in installing the temporary vertical shoring adds not only time to the construction process, but also might inadvertently result in the demolition of elements of the highway not marked for construction, such as previously-installed storm drainage piping, just for the sake of installing the temporary shoring. Also, the presence of the temporary shoring raises the possibility of its failure or movement, whereby such not-marked-for construction elements including the adjacent roadway surface being traveled on by the general public are damaged, or worse yet, rendered unsafe.

As can be seen, there is a need for a one-step sheet pile retaining wall system not requiring temporary shoring yet adapted to accommodate significant embankment widening along existing roadway where traffic will be running adjacent to the work area. The one-step sheet pile retaining wall system embodied herein provides an outer row of sheet piles that constitutes the wall portion of the structure with perpendicular sheets comprising fins connected to the outer sheets via three-way connectors along the length of the wall. The sheet pile retaining wall for all practical purposes would be built without the need for massive quantities of excavation, select rock/aggregate backfill, or temporary shoring.

The present invention reduces the earth retaining process to only one stage, i.e., the actual construction of the wall. This one step approach, ideally, results in the realization of significant time savings in addition to the cost reductions, assuming sheets can be driven to the required depth without too much difficulty. If deemed advantageous to shorten the overall time required for sheet pile installation, driving shoes could be used to help in this regard.

SUMMARY OF THE INVENTION

In one aspect of the present invention, the embankment widening retaining system provides a face wall defining a front face of the embankment having a gradient; the face wall including a plurality of face wall sheet piles, wherein each face wall sheet pile has a face length, the face length including a face depth extending below the gradient; and a face cantilever extending above the gradient; a group of fin sheets perpendicularly extending from the face wall; the group of fin sheets including a plurality of fin sheet piles having a fin bottom approximately the same elevation as the face bottom, and wherein said face and fin sheet piles are generally corrugated (Z-shaped); a cementitious flowable backfill disposed in a backfill space defined by the gradient, the face cantilever, and adjacent fin sheet cantilever; a drainage/utility cradle disposed in a cradle space paralleling the wall face defined by the face or adjacent fin sheet, the cementitious flowable backfill, and higher, adjacent fin sheets away from the wall face edging the cradle; and a three-way connector interconnecting each adjacent face wall sheet piles and first fin sheet pile.

In another aspect of the present invention, the embankment widening retaining system generally includes one brace fin sheet pile, each brace fin sheet pile spaced apart along and perpendicularly connected to the face wall and higher than those sheets defining the bottom of the drainage cradle (which is seated on the cementitious flowable backfill), the relevance of said higher first fin sheet being its significance in serving to reduce stresses in the wall face.

In yet another aspect of the present invention, the cementitious flowable backfill in its initial fluid state will serve to prestress the wall system including face and fins, and in its set state will help reduce overall pressure acting on the wall face.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a one-step sheet pile retaining wall system not requiring temporary shoring. The wall system may provide a front face having a plurality of interlocked fin sheets perpendicularly extending therefrom. Between the gradient and the higher front face and adjacent fin sheets will generally be cementitious flowable backfill for pre-stressing the wall system when fluid—along with reducing overall pressure on the wall face when set, thereby supporting a drainage cradle of sufficient width from which storm drainage/utility construction may occur. Between the slope of the existing embankment gradient and the higher front wall face may be cementitious flowable backfill for pre-stressing the wall system when fluid and, when set, supporting the aforementioned cradle, from which the remaining construction can build off of while reducing overall earth pressure acting on the wall face upon completion of construction as a result of this set.

Figure 1:
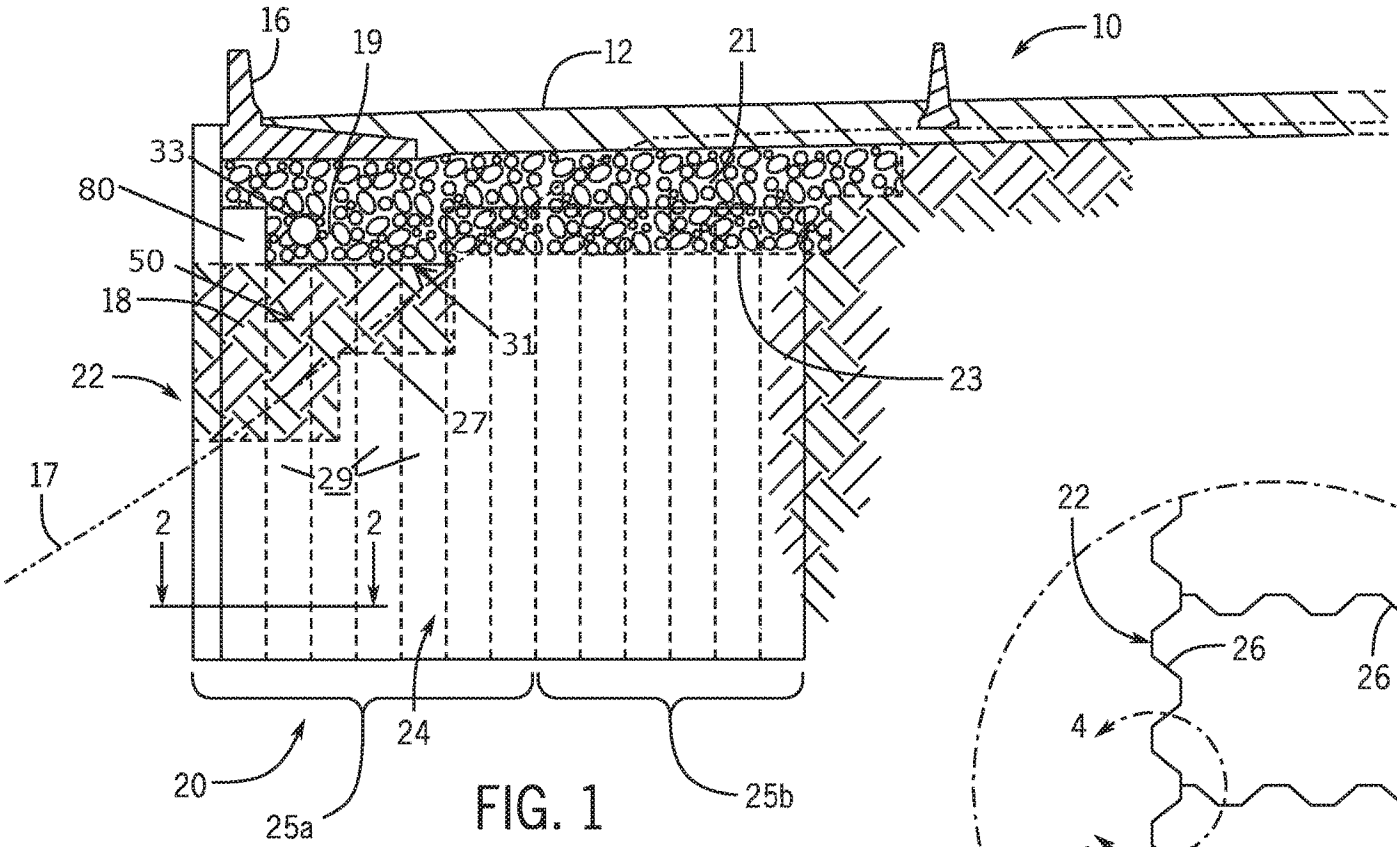
FIG. 1 is an elevation view of an exemplary embodiment of the present invention.
Figure 2:
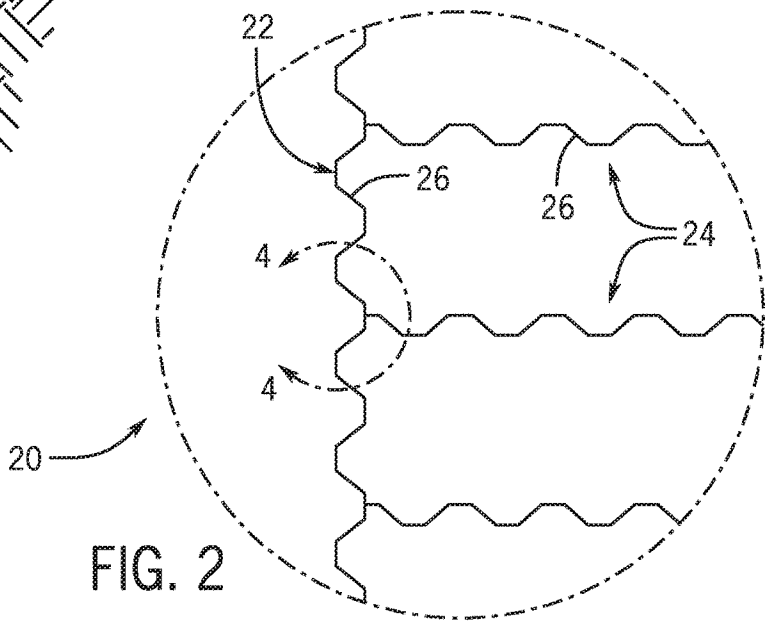
FIG. 2 is a schematic plan view of an exemplary embodiment of the present invention, taken along plane 2-2 of FIG. 1.
Figure 3:
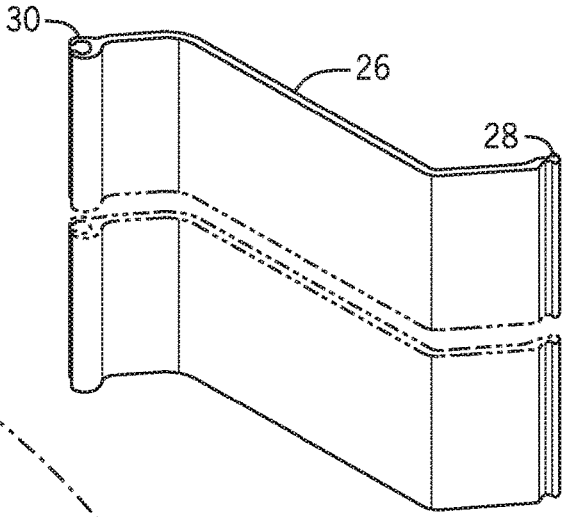
FIG. 3 is a perspective view of an exemplary embodiment of an individual sheet pile of the present invention.
Figure 4:
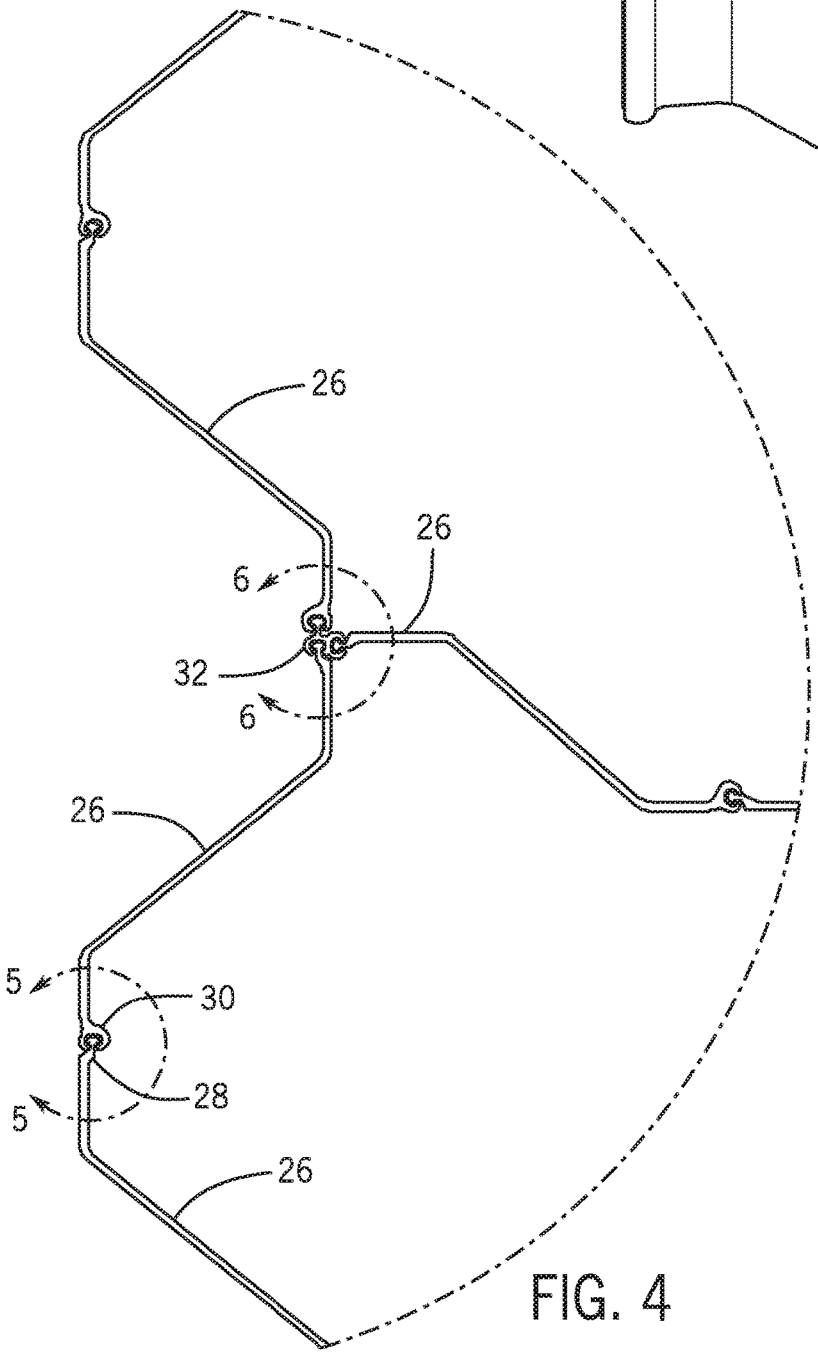
FIG. 4 is an enlarged detail plan view of an exemplary embodiment of the present invention, taken along line 4-4 of FIG. 2.
Figure 5:
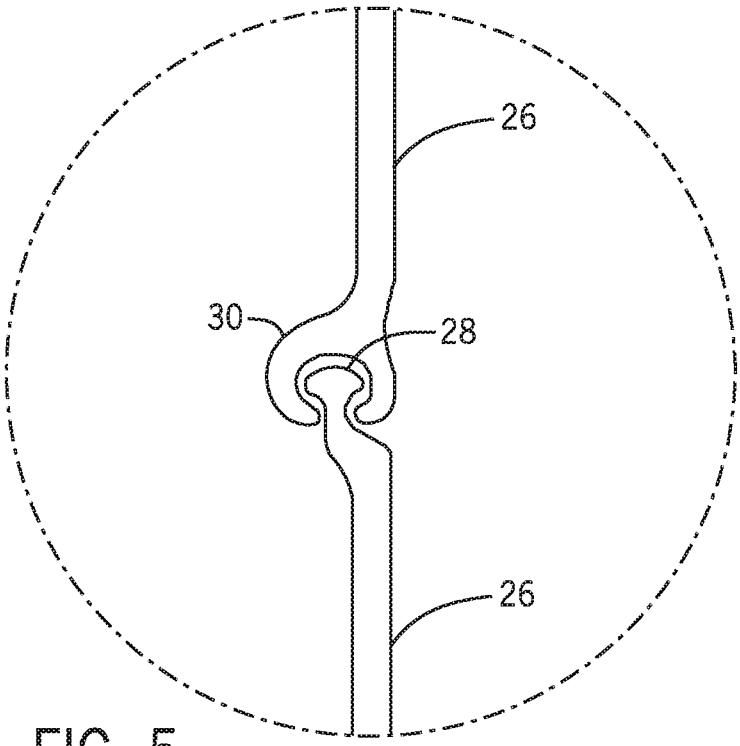
FIG. 5 is an enlarged detail plan view of an exemplary embodiment of the present invention, taken along line 5-5 of FIG. 4.

Referring to FIGS. 1 through 7, the present invention may include a one-step sheet pile retaining wall system 10 not requiring temporary shoring. The one-step sheet pile retaining wall system 10 may include a sheet pile assembly 20 driven into an embankment having a gradient 17, for retaining proposed embankment. The sheet pile assembly 20 provides a front face wall 22 including a plurality of interconnected face sheet piles forming an exterior element facing an exterior environment, while opposing a portion of existing embankment. The system also includes a fin sheet pile assembly 24 perpendicularly connected to and extending from the face wall 22 away from the exterior environment, as illustrated in FIGS. 1 and 2. The fin sheet pile assembly 24 may include a plurality of brace fin sheet piles 80 individually spaced apart along and connected to the wall face 22 substantially bracing the wall face 22 cantilevering above the brace wall sheets 80. Connected to each brace fin sheet piles 80 is the remainder of fin sheet piles, which in turn provide for the adjacent, depressed drainage cradle 19 and then remainder of higher fin sheets beyond. Those fin sheets located farther away from the face wall 22 provide more resistance to earth pressure acting on the wall than those closer given their distance from the face wall 22 based on earth pressure theory along with their greater buried length.

It should be understood by those skilled in the art that the use of directional terms such as above, below, and the like are used in relation to the illustrative embodiments as they are depicted in FIG. 1, the above direction being further toward the top of the corresponding figures and a downward direction being further toward the bottom of the corresponding FIG. 1.

The cementitious flowable backfill 18 may be used as a pre-stressing measure described more in depth below. In certain embodiments, the cementitious flowable backfill 18 may be operatively engaged to the face wall 22 and fin sheets 80 and 24 (for example via shear studs and reinforcing within the cementitious flowable backfill mass) to help hold back the face wall 22 upon set.

Moreover, the cementitious flowable backfill 18 enables the seating of a drainage cradle 19 on the set cementitious flowable backfill 18. Once the cementitious flowable backfill 18 hardens, it no longer pushes directly against the face wall 22, but sits down vertically on its notched bottom within the embankment. From there, the hardened cementitious flowable backfill 18 provides a platform/pathway for the drainage cradle 19, which is being designed to accommodate pipes/utilities behind the front face wall 22.

Figure 6:
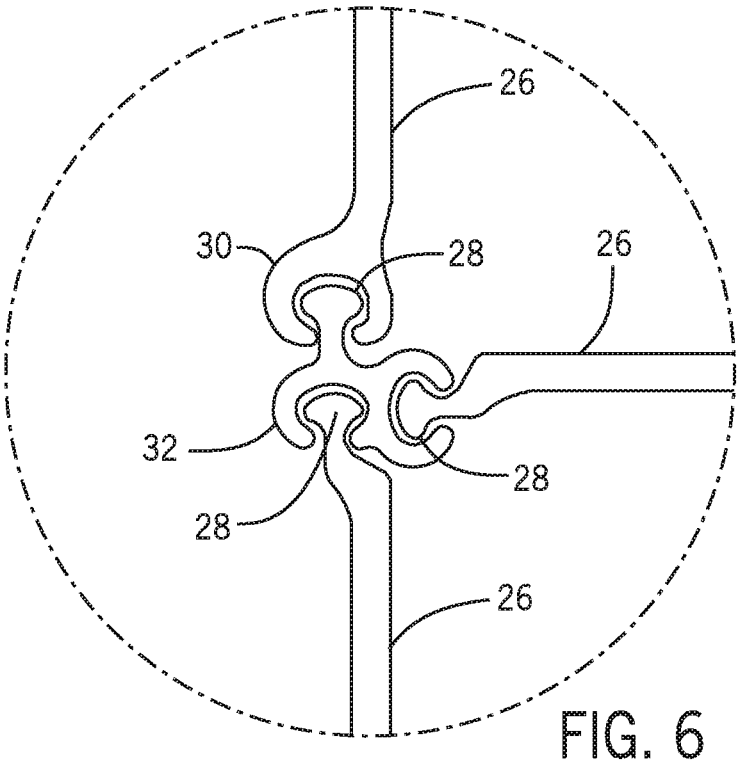
FIG. 6 is an enlarged detail plan view of an exemplary embodiment of the present invention, taken along line 6-6 of FIG. 4.

Referring to FIGS. 3 through 6, each sheet pile 26 may be corrugated (Z-shaped) as it extends from a male interlocking end 28 to a female interlocking end 30 for enabling adjacent sheet wall piles 26 to be interlocked. In other words, a soil anchor is provided by mating the male interlocking end 28 at one end of a first sheet 26 to a second female interlocking end 30 at the end of a second sheet 26. The interlocking of fin sheet piles and face wall sheet piles happens at the interface of two adjacent face wall sheets via a three-way connector 32, as illustrated in FIG. 6. The three-way connector 32 provides a profile and/or arrangement of male interlocking ends 28 and female interlocking ends 30 as illustrated in FIG. 6.

Geotechnical Considerations

The perpendicular sheets will serve as vertically planar, continuous tiebacks, i.e., fins providing resistance to lateral loading acting on the wall through the following mechanisms: a) soil/steel interaction, i.e., shear resistance including friction (and cohesion) and b) the dead weight of the fins including soil adhering to them enhanced by vibratory densification during pile driving to provide additional restoring moment to the overall wall system. It being understood that the design of the sheet pile wall system 10 as well as the designs of other wall types—particularly those founded within slopes—will need to consider global stability as part of the overall design process—as well as other design criteria peculiar to each wall type. It being understood that the embankment being retained has an upper surface, the inclined part of the embankment, or gradient.

In one embodiment, the sheet pile wall system 10 may incorporate cementitious flowable backfill 18 in a backfill portion of the wedge defined by the existing ground slope/gradient and the wall face 22, said backfill portion being bounded along its upper periphery by the pipe/utility cradle 19. The cementitious flowable backfill 18 is generally less expensive than properly-compacted embankment material, select or otherwise, as the compacted embankment material requires placement in relatively-thin lifts, which in turn requires significantly more time for placement and compaction to achieve a comparable degree of performance from a settlement-limiting aspect. The hydrostatic fluid pressure of the cementitious flowable backfill 18 will act to pre-stress the wall system 10 prior to set before placement of the overlying backfill and pavement structure. And by incorporating step notching 27, as illustrated in FIG. 1, into the existing embankment slope, wedge-type, block loading acting on the wall face will be eliminated upon set of the cementitious flowable backfill material 18 within the backfill space 50 defined by the wall face 22 and the step notching 27 into the gradient 17.

Structural Considerations

From a structural standpoint, the most critical point along the wall face is where it is cantilevered above the brace fin sheet pile 80 directly connecting to the face with moment within the wall sheet being the controlling factor in its design. The brace fin sheet pile 80 connected to the wall face 22 is higher than the adjoining several cradle fin sheets 29, the tops of which are depressed from sheets on either side, terminating at cradle bottom 31, to serve as a cradle 19 to allow for construction of pipes/utilities 33 behind the wall face 22, as illustrated in FIG. 1. By limiting the cantilever height, the maximum moment (and required section modulus, which is a function of the square of the unsupported height) will be limited. This feature along with the composite effect provided by the corrugated nature of the steel sheet piles interacting with the cementitious backfill (whether reinforced or not) is key to the design concept—and why it can be so competitive in cost when compared to other wall types in that relatively lighter, i.e., less expensive, wall face sheet sizes (weights) may be employed.

The fin sheets will act in tension—serving as vertically-planar, continuous anchors—providing resistance to lateral movement of the wall face 22. With the strength of steel being measured in tens of thousands of kips per square inch, the interconnected, continuous nature of sheet piles results in loadings in tension being relatively low when compared to the available strength—and it is for this reason that fin sheet sizes (weights) may be considerably less than sheet sizes required for the wall face.

In addition to essentially eliminating the need for temporary shoring to allow for the construction of this particular sheet pile retaining wall system 20, the other big key to its economic success is the methodology for how it is constructed.

Construction Methodology

Basically, a temporary working bench 23 upon which the pile driving unit would be situated would be excavated to a depth of 18 inches to 2 feet below the innermost fin sheets, i.e., those sheets situated higher on the embankment closer to active traffic. (The 18 inch to 2 foot clearance would allow for the pile hammer to grab/secure these piles for subsequent driving.) Generally speaking (but not always), sheet piles would be driven in two groups to allow for greater constructability. Group 1 piles 25*a* would include the wall face 22 and those fin piles in the immediate area of the roadway drainage/utility cradle. A sufficient number of fin sheets would be installed to provide a) the necessary lateral restraint of the wall face through tensional fin resistance and b) sufficient capacity to resist overturning of the enclosed gravity mass to allow for backfilling up to the bottom of the cradle with cementitious, flowable material for this temporary loading condition.

Following Group 1 pile 25*a* installation and cementitious, flowable backfill installation, Group 2 pile 25*b* installation to complete fin installation would begin. (This cementitious backfill—once set after placement in lifts generally limited to a 3 to 4-foot maximum thickness—will serve to reduce loading on the wall face 22 which is not only an important feature for the completed wall system 10 but also a factor in limiting loading on the wall face 22 when backfilling up to the bottom of the cradle 19 with only Group 1 piles 25*a* in place). And once Group 1 25*a* and Group 2 piles 25*b* are in place within a given stretch of highway, backfilling with earthen (non-cementitious) material beneath the entire roadway in the wall construction zone would occur. In conjunction with this construction would be installation of roadway drainage (and utilities) within the specified cradle 19. At this point, construction of the overlying pavement structure and moment slab/safety barrier (or guide rail) would then occur. Please see the FIG. 7 "Block Diagram for Installation of Sheet Pile Retaining Wall System (Consisting of Wall Face and Perpendicular Fins for Anchorage).

Now with particular regard to the development of tension in the wall fins, a slight, inward transverse force would be applied to the fin sheets during vibrating/driving, thus removing play in the interlocks. As necessary to keep the wall face within horizontal tolerance, wall sheets at the 3-way connectors 32 would be re-visited and a slight, outward transverse force would be applied to the pile hammer. Vertical tolerance would be achieved by driving pile lengths longer than design lengths and cutting/burning off the excess.

Figure 7:
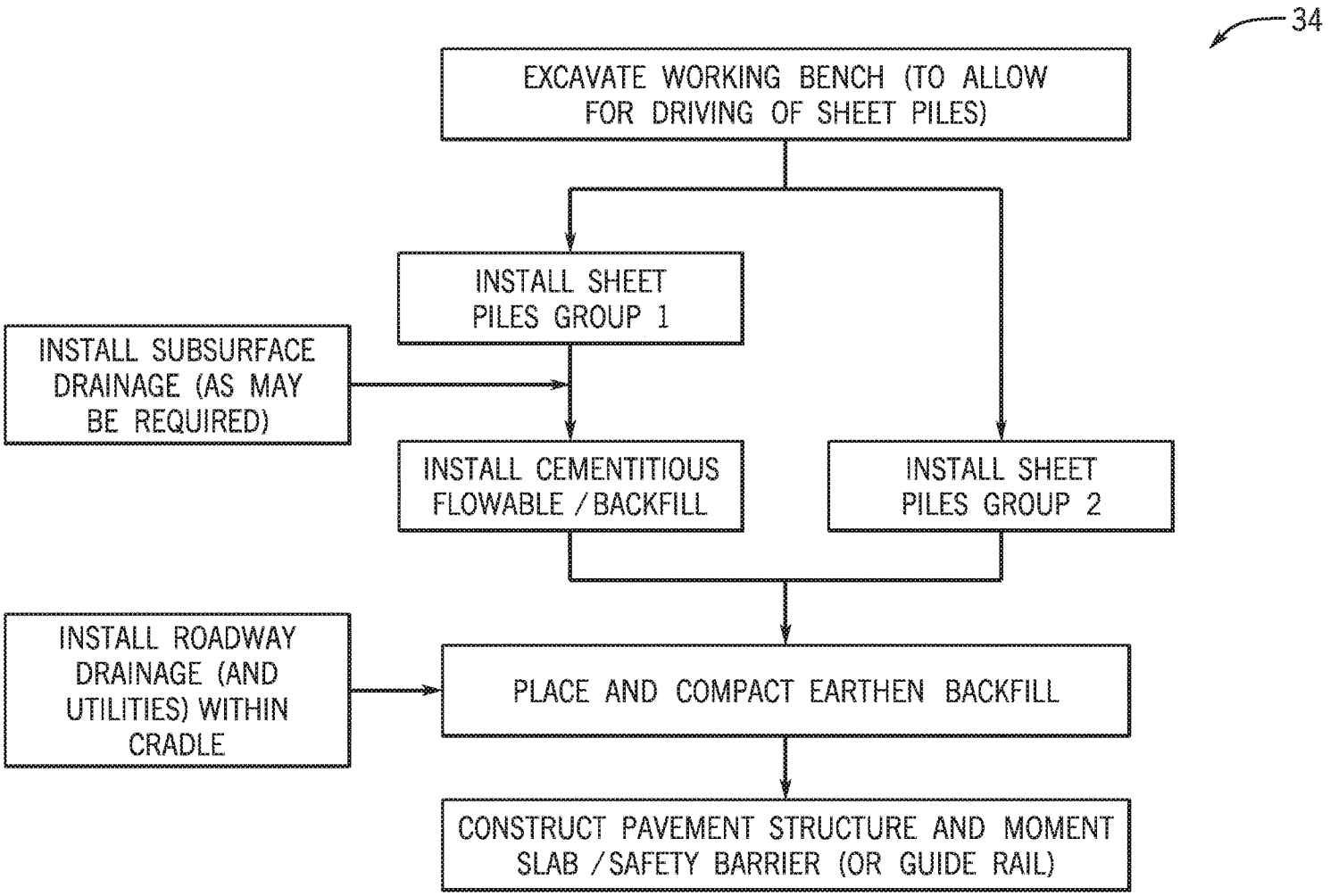
FIG. 7 is a block diagram view of an exemplary embodiment of the present invention.

Referring to FIG. 7, a method 34 of employing the present invention may include the following. The one-step sheet pile retaining wall system 10 disclosed above may be provided. After excavating for a temporary work bench 23 to allow for driving of sheet piles, installation of sheet pile group one 25*a* may commence. In certain embodiments, installation of subsurface drainage may be required. Then installation of the cementitious flowable backfill 18 would occur followed by the installation of roadway drainage and utility(ies) within the drainage cradle 19. And with the installation of sheet pile group two 25*b*, the placement and compaction of earthen backfill 21 may then be completed. Construction of the pavement structure 12 and moment slab/safety barrier 16 or optional guide rail would then follow.

It should be understood, of course, that the foregoing relates to exemplary embodiments of the invention and that modifications may be made without departing from the spirit and scope of the invention as set forth in the following claims.

What is claimed is:

1. An embankment retaining system, comprising:

a face wall defining a front face of the embankment having an existing gradient;

the face wall including a plurality of face wall sheet piles, wherein each face wall sheet pile terminates at a cantilever elevation located above the gradient;

at least one brace fin sheet pile, each brace fin sheet pile spaced apart along and perpendicularly connected to the face wall, each brace fin sheet pile terminating at a brace elevation located between the cantilever elevation and the gradient;

a plurality of cradle fin sheet piles connected linearly to each brace fin sheet pile, each plurality of cradle fin sheet piles terminating at a cradle elevation located below the brace elevation but above the gradient; and a plurality of resistance fin sheet piles connected linearly to each plurality of cradle fin sheet piles, wherein each plurality of resistance fin sheet piles terminates at a resistance elevation located above the cradle elevation, whereby each plurality of cradle fin sheet piles interconnects each respective brace fin sheet pile and respective plurality of resistance fin sheet piles so that said respective sheet piles define a linear relationship relative to each other; further comprising: a cementitious backfill disposed in each backfill space defined by the gradient, the face wall, and adjacent pluralities of the cradle fin sheet piles.

2. The embankment retaining system of claim 1, further comprising:

a drainage/utility cradle seated on the cementitious backfill.

3. The embankment retaining system of claim 1, wherein the gradient is step notched so as to further define the backfill space.

4. The embankment retaining system of claim 1, further comprising:

a three-way connector interconnecting each adjacent face wall sheet piles and each brace fin sheet pile.

5. The embankment retaining system of claim 1, wherein all sheet piles are generally corrugated.

6. A method of installing a retaining system for widening of an embankment having a gradient, the method comprising the steps:

driving an embankment retaining system into the embankment, the embankment retaining system comprising:

a face wall defining a front face of the embankment having an existing gradient;

the face wall including a plurality of face wall sheet piles, wherein each face wall sheet pile terminates at a cantilever elevation located above the gradient;

at least one brace fin sheet pile, each brace fin sheet pile spaced apart along and perpendicularly connected to the face wall, each brace fin sheet pile terminating at a brace elevation located between the cantilever elevation and the gradient;

a plurality of cradle fin sheet piles connected linearly to each brace fin sheet pile, each plurality of cradle fin sheet piles terminating at a cradle elevation located below the brace elevation but above the gradient; and a plurality of resistance fin sheet piles connected linearly to each plurality of cradle fin sheet piles, wherein each plurality of resistance fin sheet piles terminates at a resistance elevation located above the cradle elevation, whereby each plurality of cradle fin sheet piles interconnects each respective brace fin sheet pile and respective plurality of resistance fin sheet piles so that said respective sheet piles define a linear relationship relative to each other, and wherein the face wall, the gradient, and adjacent pluralities of cradle fin sheet piles define a backfill space; and pouring a cementitious flowable backfill in each backfill space so as to pre-stress the face wall and said respective sheet piles.

7. The method of claim 6, further comprising the steps of:

allowing the cementitious flowable backfill to set; and seating a drainage/utility cradle on the set cementitious backfill, wherein the set cementitious backfill serves to reduce stresses acting on the face wall for a completed condition.

8. The method of claim 6, wherein temporary shoring to support an adjacent highway is not provided.

9. The method of claim 6, further comprising step-notching the gradient before pouring the cementitious flowable backfill.

* * * * *